US011078666B2

(12) United States Patent
Darwell

(10) Patent No.: US 11,078,666 B2
(45) Date of Patent: Aug. 3, 2021

(54) FORMWORK SYSTEM

(71) Applicant: CSR Building Products Limited, North Ryde (AU)

(72) Inventor: Stephen W. Darwell, North Ryde (AU)

(73) Assignee: CSR Building Products Limited

( * ) Notice: Subject to any disclaimer, the term of this patent is extended or adjusted under 35 U.S.C. 154(b) by 0 days.

(21) Appl. No.: 16/491,551

(22) PCT Filed: Mar. 6, 2018

(86) PCT No.: PCT/AU2018/050203
§ 371 (c)(1),
(2) Date: Sep. 5, 2019

(87) PCT Pub. No.: WO2018/161115
PCT Pub. Date: Sep. 13, 2018

(65) Prior Publication Data

US 2020/0385986 A1 Dec. 10, 2020

(30) Foreign Application Priority Data

Mar. 6, 2017 (AU) ..... 2017900766

(51) Int. Cl.
*E04B 2/86* (2006.01)

(52) U.S. Cl.
CPC ..... *E04B 2/8629* (2013.01); *E04B 2/8647* (2013.01); *E04B 2/8652* (2013.01); *E04B 2002/867* (2013.01); *E04B 2002/8676* (2013.01)

(58) Field of Classification Search
CPC .... E04B 2/8629; E04B 2/8647; E04B 2/8652; E04B 2002/887; E04B 2002/8676
See application file for complete search history.

(56) References Cited

U.S. PATENT DOCUMENTS 5,740,648 A 4/1998 Piccone
6,694,692 B2 2/2004 Piccone
7,628,570 B2 * 12/2009 Davidsaver ..... E02B 3/06 405/284
9,850,658 B2 * 12/2017 Alcala Ordaz ..... E04B 2/8658
(Continued)

FOREIGN PATENT DOCUMENTS

CA 2299193 8/2001
CA 2329358 6/2002
(Continued)

OTHER PUBLICATIONS

International Search Report and Written Opinion issued in PCT/AU2018/050203 dated Apr. 19, 2018.

*Primary Examiner* — Rodney Mintz
(74) *Attorney, Agent, or Firm* — Workman Nydegger

(57) ABSTRACT

Disclosed is a form work system (100) that comprises first (102*a*) and second (102*b*) building formwork components that are connected by a building formwork connector (104). The connector (104) comprises a moveable portion (128) that is moveable from a closed position to an open position. In the closed position, one or more sidewalls of the connector (104) define a cavity (144) for receipt of cementitious material. The cavity (144) of the connector (104) is located with respect to cavities (110) of the first (102*a*) and second (102*b*) formwork components. In the open position, access is provided to the cavity (144) of the connector (104).

16 Claims, 9 Drawing Sheets

(56) References Cited

U.S. PATENT DOCUMENTS

| | | | | |
|---|---|---|---|---|
| 10,364,570 | B2 * | 7/2019 | Johnston | E04G 11/06 |
| 2005/0053429 | A1 * | 3/2005 | Davidsaver | E02D 5/03 405/284 |
| 2007/0217870 | A1 * | 9/2007 | Davidsaver | E02B 3/06 405/284 |
| 2014/0318067 | A1 | 10/2014 | Richardson et al. | |
| 2015/0275531 | A1 | 10/2015 | Ordaz | |
| 2018/0340332 | A1 * | 11/2018 | Johnston | E04G 17/001 |

FOREIGN PATENT DOCUMENTS

| | | | | |
|---|---|---|---|---|
| CA | 2855739 | A1 | 5/2013 | |
| CN | 101970770 | A | 2/2011 | |
| CN | 105705711 | A | 6/2016 | |
| EP | 3592921 | A1 | 1/2020 | |
| GB | 1452706 | A | 10/1976 | |
| WO | 2013/075250 | A1 | 5/2013 | |
| WO | WO-2013075250 | A1 * | 5/2013 | E04G 17/06 |
| WO | 2016154670 | A1 | 10/2016 | |
| WO | 2018/161115 | A1 | 9/2018 | |

* cited by examiner 322
322
358
360
330
366

356
343
354
346
354
1.80
1.80
342
328

324
365
364
332
362
358
324
356

FORMWORK SYSTEM

CROSS-REFERENCE TO RELATED APPLICATIONS

This application claims priority to PCT Application No. PCT/AU2018/050203, filed Mar. 6, 2018, entitled "FORMWORK SYSTEM", which claims the benefit of and priority to Australia Application No. 2017900766, filed Mar. 6, 2017. All the aforementioned applications are incorporated by reference herein in their entirety.

TECHNICAL FIELD

This disclosure relates to a connector for building formwork components of the type that comprise a cavity for receipt of cementitious material. The connector has particular, but not exclusive, use in the construction of building structures such as walls.

BACKGROUND ART

Formwork is used in the construction of buildings and other structures to provide a temporary or permanent mould into which concrete or other similar materials may be poured.

One type of permanent formwork is often referred to as 'stay-in-place' formwork. Such formwork may be formed of a polymer and can comprise a number of components that are connected to one another to form a structure such as a wall.

In some cases, it may be desirable to inspect and/or maintain internal parts of the formwork (i.e. prior to the formwork being filled with concrete or other materials), but such inspection/maintenance can be difficult to perform with known formwork arrangements.

It is to be understood that, if any prior art is referred to herein, such reference does not constitute an admission that the prior art forms a part of the common general knowledge in the art, in Australia or any other country.

SUMMARY

Disclosed herein is a building formwork connector for connecting building formwork components that are each of a type that comprises a cavity for receipt of a cementitious material. The connector comprises engagement portions for engaging first and second of the building formwork components. The connector also comprises one or more sidewalls. The one or more connector sidewalls comprise at least a portion that is movable from a closed position to an open position. In the closed position the one or more connector sidewalls define a cavity for receipt of cementitious material. The cavity defined by the connector is located with respect to the cavities of the first and second formwork components. For example, the cavity defined by the connector may be adjacent to the cavities of the first and second formwork components. In the open position, access is provided to the cavity defined by the connector (hereafter the "connector cavity").

The connector may define a corner of the interconnected building formwork components.

Access to the connector cavity may be desirable, for example, to inspect or maintain parts of the connector or other components or materials (e.g. to the associated building formwork components; to reinforcing such as rods or bars, reinforcing ties; to services; etc.) that can be disposed within the connector cavity. Inspection and/or maintenance may be undertaken prior to filling of the connector cavity with cementitious material.

Access to the connector cavity may be especially desirable to facilitate installation and/or maintenance of building formwork components such as reinforcing bars, ties, etc. Such installation and/or maintenance can be required when the connector has been prior-connected to the building formwork components. For example, the connector may be in place prior to the installation of such reinforcing bars, etc. and it may be important to position such reinforcing bars, etc. accurately within the connector cavity. By way of further example, the connector can be prior-connected with the first and second building formwork components, and then components such as reinforcing bars, ties, etc. can be subsequently installed.

As set forth above, the one or more connector sidewalls comprise at least a portion that is movable from a closed position to an open position. In one embodiment, this moveable portion may take the form of e.g. a portion that is hingedly connected to a body of the connector (e.g. to hinge and pivot between the closed and open positions). In another embodiment, this moveable portion may take the form a portion that slides relative to a body of the connector to provide access to the cavity (e.g. to slide between the closed and open positions).

In one embodiment the moveable portion may comprise a detachable element that, when detached, opens the connector cavity to provide access thereto. Alternatively, the moveable portion may be in the form of a hinged, sliding, pivoting, rotating, etc. element or door which, when opened, provides access to the connector cavity. The moveable portion may be integral (e.g. integrally formed) with a remainder of the connector. The moveable portion may comprise an entire sidewall of the connector, or it may form only part of a sidewall of the connector.

In one embodiment the connector may further comprise a connecting element (e.g. as a further component of the connector). The connecting element may comprise engagement portions for engaging each of the first and second formwork components.

In one embodiment the connector cavity may be defined between the detachable element/moveable portion and the connecting element. That is, the detachable element/moveable portion and the connecting element may, together, form sidewalls of the connector that surround the cavity. In this way, detachment or movement away of the detachable element/moveable portion from the connecting element may allow access to the connector cavity. Thus, the connecting element can stay-in-place during such detachment or movement away.

The nature of the connection of the connecting element with a given formwork component may be dictated by the type of formwork components to be used with the connector.

For example, in one embodiment the connecting element may be engageable with at least one of the first and second formwork components by way of a sliding arrangement.

In another embodiment the connecting element may be engageable with at least one of the first and second formwork components by way of a snap-fit arrangement. For example, the connecting element and corresponding formwork components may comprise clips, flanges, grooves, ramp surfaces, etc. that are able to flex so as to snap-engage with one another. This may facilitate quick and easy connection of the connecting element to the first and second formwork components.

In one embodiment the connecting element may comprise first and second connecting sidewalls. The first and second connecting sidewalls may be integral with each other (i.e. to define the connecting element as a unit), or the first and second connecting sidewalls may be separated.

The first connecting sidewall may be configured to extend across an end of the first formwork component when engaged thereto. The second connecting sidewall may be configured to extend across an end of the second formwork component when engaged thereto. In this way, the first and second connecting sidewalls may cap the ends of respective first and second formwork components.

In one embodiment the first and second connecting sidewalls may be arranged to be generally perpendicular to one another. Such an arrangement may be particularly suited when the first and second formwork components are also disposed so as to be perpendicular to one another (e.g. at a corner). However, the connecting sidewalls may be disposed at an obtuse or acute angle with respect to one another. For example, this may be desirable where the connector is used to form a join between two wall structures that meet at an angle other than 90 degrees.

In one embodiment the first connecting sidewall may comprise at least one engaging flange extending therefrom to engage corresponding flanges of the first formwork component. The engaging flange may extend longitudinally along an edge of the first connecting sidewall and may be configured for sliding- or snap-engagement with a corresponding flange of the first formwork component.

In one embodiment the second connecting sidewall may comprise at least one engaging flange to engage a corresponding groove of the second formwork component. Again, the engaging flange may be configured for sliding- or snap-engagement with the corresponding groove of the second formwork component.

In one form, the detachable element may be detachably connectable to the connecting element. In such a case, the connector may take the form of either an integral one-piece connector, or a two-piece connector. The connecting element may in turn be connectable to at least one, and typically to each of the first and second formwork components.

In one embodiment the detachable element may be connectable to the connecting element by way of a sliding arrangement.

In another embodiment the detachable element may be connectable to the connecting element by way of a snap-fit arrangement. In this regard, the detachable element may comprise e.g. clips, flanges, grooves, ramp surfaces, etc. that are configured to flex so as to snap-engage each other.

In another from the detachable element may be detachably connectable (i.e. directly) to at least one of the building formwork components. In this way, both the connecting element and the detachable element may be connectable to at least one building formwork component. This may provide a more rigid connection between the connector and the building formwork components.

In one embodiment the detachable element may comprise two external sidewalls that can define an external corner of the connector. The detachable element may further comprise an internal sidewall that extends between the two external sidewalls. The internal sidewall can partially define the connector cavity (i.e. an inner face of the internal sidewall can face into the cavity). The internal sidewall may have a curved or arcuate profile.

In one embodiment the external sidewalls and internal sidewall of the detachable element may be arranged to configure the detachable element as a generally hollow section. The hollow section may provide rigidity to the detachable element (even when not attached) and may help to resist torsional loads.

In one embodiment support webs may extend within the hollow section, i.e. between the internal sidewall and external sidewalls. These webs can help (e.g. in addition to the hollow section) to stiffen the detachable element. This increased stiffness can assist with resistance of hydraulic pressure applied to the detachable element, such as by a cementitious material arranged in the cavity.

In one embodiment an outer surface of the connector may be configured to be generally flush with corresponding outer surfaces of the first and second formwork components when engaged thereto. This can allow, for example, a flush corner to be defined. This flush corner may be provided by the external sidewalls of the detachable element of the connector.

In one embodiment one or more of the sidewalls of the connector may comprise at least one aperture for receipt of a reinforcement member (e.g. a reinforcing bar or rod) therethrough. The reinforcement member may be able to extend from the connector cavity defined by the one or more sidewalls and into a cavity of an adjacent, interconnected formwork component. Multiple such reinforcement members may be provided.

In one embodiment the connector may be configured to connect building formwork components (e.g. the first and second formwork components) that are disposed so as to be generally perpendicular to one another. This arrangement may be used to form a right-angled corner of a structure.

In one embodiment the connector cavity defined by the one or more sidewalls of the connector, may be in fluid communication with a cavity of at least one of the first or second building formwork components. This may allow cementitious material to flow between the cavities in use. It may also allow other fluids, such as a gas, water, liquid, or other flowable solid to flow therebetween.

Also disclosed herein is a building formwork system comprising first and second building formwork components (e.g. as set forth above). A connector (e.g. as set forth above) can connect the first and second building formwork components. Each of the first and second building formwork components comprises spaced sidewalls having one or more webs extending therebetween. The spaced sidewalls hand webs can define cavities for receipt of a cementitious material therein. The connector comprises one or more sidewalls having at least a portion that is movable from a closed position to an open position. In the closed position the one or more sidewalls define a cavity for receipt of the cementitious material. The connector cavity can be located with respect to the cavities of the first and second formwork components. In the open position access is provided to the connector cavity.

In one embodiment the building formwork components and connector may form a corner of a wall structure. The corner may define an angle that is approximately 90 degrees, or may define an obtuse or acute angle depending on the configuration of the connector and the structure.

In one embodiment one or more of the sidewalls of the connector may comprise at least one aperture for receipt of a reinforcement member (e.g. a reinforcing bar or rod) therethrough. The reinforcement member may provide further strength to the system once cementitious material has been received in the cavity. The moveable portion of the connector, when in the open position, may allow access to the reinforcement member (or portion thereof). In practice, this may allow the system to be formed up on site, and may then allow for inspection and/or maintenance of the reinforcement member to occur (i.e. without completely dismantling the assembled system). This inspection and/or maintenance can take place prior to filling the cavities with cementitious material.

In one embodiment the building formwork system may further comprise at least one reinforcement member extending through the at least one aperture and into the cavity of a respective building formwork component. An end of the at least one reinforcement member may be disposed in the cavity defined by the sidewalls of the connector.

In one embodiment the reinforcement member may be generally U-shaped, at least at an end portion thereof. Legs of the U-shaped reinforcement member/portion may extend through apertures in the sidewalls of the connector and into the cavities of the building formwork component. A base of the reinforcement member may be disposed in the connector cavity. When the reinforcement member comprises the U-shape at an end portion thereof, one leg of the U-shaped reinforcement member may be shorter than the other, such that only a small portion of the leg extends in the cavity of the building formwork component (or the leg does not extend into that cavity at all). The U-shape can help function to hold the orientation of each reinforcement member (e.g. by helping to hold the end in place, and by stopping it from rotating on its elongate axis).

Also disclosed herein is a method of building a structure. The method comprises providing a building formwork system as set forth above, in the closed position. The method also comprises configuring the connector so as to be in the open position to access the connector cavity. The method further comprises configuring the connector so as to be in the closed position (e.g. to be returned to the closed position). The method additionally comprises at least partially filling the connector cavity with a cementitious material.

In one embodiment of the method, the connector may be configured so as to be in the open position to inspect the connector cavity.

In one embodiment the method may further comprise configuring the connector so as to be in the open position and installing one or more elongate reinforcement members (e.g. rods/bars, etc.) through apertures of the building formwork components and the connector. When the connector cavity is at least partially filled with the cementitious material, the one or more elongate reinforcement members can interact with and thereby reinforce the cementitious material once cured.

In one embodiment of the method, the reinforcement members may be installed so as to extend generally perpendicular to a longitudinal axis of the connector cavity.

Also disclosed herein is a building formwork connecting element for connecting building formwork components that are each of the type that comprises a cavity for receipt of a cementitious material. The connecting element comprises a first set of engagement portions for engaging first and second building formwork components. The connecting element also comprises a second set of engagement portions for detachable mounting of a detachable element. When the detachable element is engaged with the connecting element, it can define a cavity for receipt of cementitious material therein. The cavity can be located with respect (e.g. adjacent) to the cavities of the first and second formwork components. When the second set of engagement portions are detached from the detachable element, access is provided to the cavity.

The connecting element may be otherwise as set forth above.

BRIEF DESCRIPTION OF THE DRAWINGS

Embodiments will now be described, by way of example only, with reference to the accompanying drawings, in which.

DETAILED DESCRIPTION

Figure 1B:
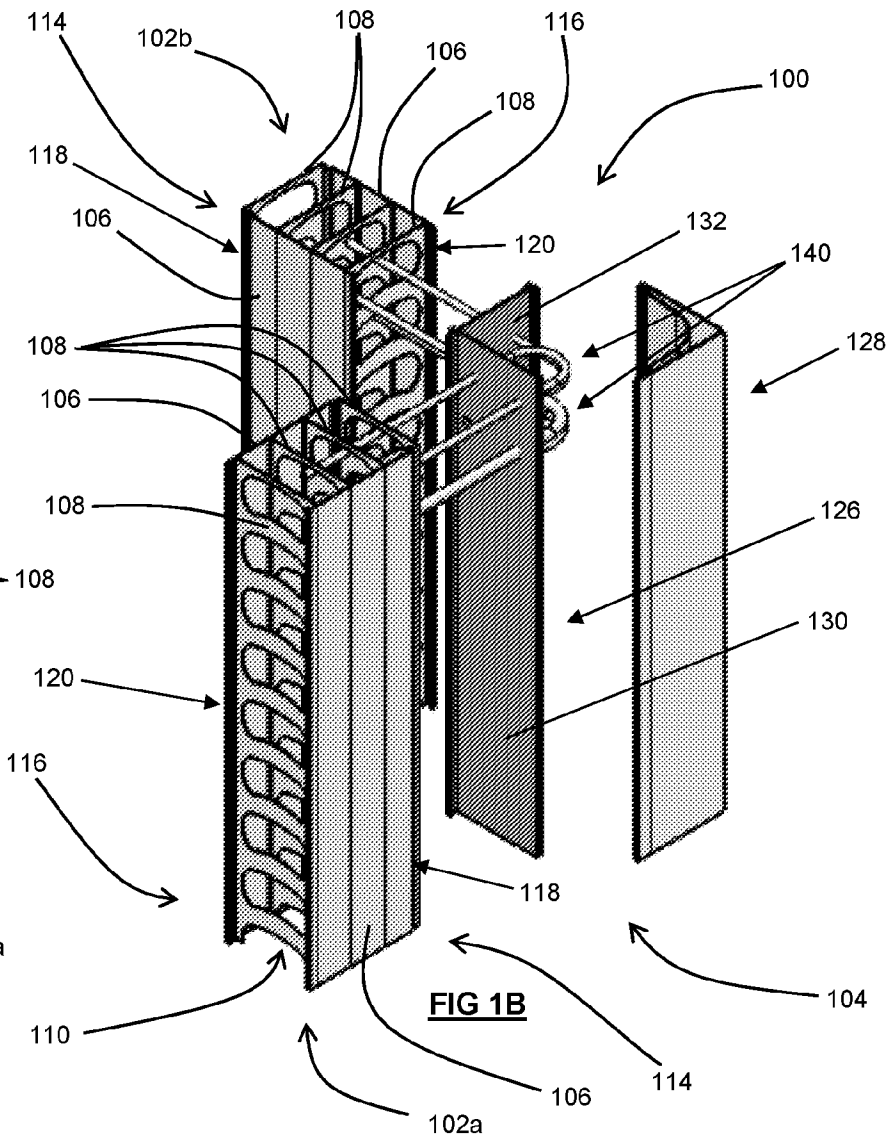
FIGS. 1A, 1B, 1C and 1D are respective perspective, exploded perspective, top and front views of a first embodiment of a formwork system.

In the following detailed description, reference is made to accompanying drawings which form a part of the detailed description. The illustrative embodiments described in the detailed description, depicted in the drawings and defined in the claims, are not intended to be limiting. Other embodiments may be utilised and other changes may be made without departing from the spirit or scope of the subject matter presented. It will be readily understood that the aspects of the present disclosure, as generally described herein and illustrated in the drawings can be arranged, substituted, combined, separated and designed in a wide variety of different configurations, all of which are contemplated in this disclosure.

Referring firstly to FIGS. 1A, 1B, 1C and 1D, the formwork system 100 comprises first 102*a* and second 102*b* building formwork components that are to be connected together by a building formwork connector 104.

The building formwork components 102*a*, 102*b*, and the connector 104, are formed of an extruded polymer, such that the features of each of these components are generally integrally formed with one another. However, flatpack (disassembled) versions of the building formwork components 102*a*, 102*b* can be provided.

The first 102*a* and second 102*b* building formwork components are substantially identical to one another. Each building formwork component 102*a*, 102*b* comprises two parallel spaced sidewalls 106 and four webs 108 extending therebetween. The sidewalls 106 and webs 108 define cavities 110 that, in use, are able to receive a cementitious material therein. The cementitious material is able to flow between the cavities 110 by way of apertures 112 that are formed in the webs (i.e. the cavities are in fluid communication—fluidly connected). The cementitious material (when set) in the building formwork components 102*a*, 102*b* and the connector 104, define a portion or section of a building structure. In the illustrated embodiment, this structure is a corner section of a wall.

Each building formwork component 102*a*, 102*b* comprises a first end 114 and an opposing second end 116. The first end 114 comprises opposing grooves 118 formed along the edges of the spaced parallel sidewalls 106 and the second end 116 comprises opposing flanges 120 that extend inwardly (towards one another) from the edges of the sidewalls 106. The grooves 118 correspond to the flanges 120 such that two formwork components 102*a*, 102*b* can be connected to one another by positioning of the flanges 120 to be received in the grooves 118 (e.g. by way of sliding or snap-fitting of the formwork components 102*a*, 102*b* relative to another).

In the illustrated embodiment, the building formwork components 102*a*, 102*b* are oriented so as to be generally perpendicular to one another, and are connected to one another by the connector 104.

More specifically, the first building formwork component 102*a* is oriented such that its first end 114 is engaged by a first set of engagement portions 122 of the connector 104. Further, the second building component 102*b* is oriented such that its second end 116 is engaged by a second set of engagement portions 124 of the connector 104. In this way, the building formwork components 102*a*, 102*b* and the connector 104 can be generally arranged to form the corner section of a wall.

The connector 104, which is disposed between the building formwork components 102*a*, 102*b*, is formed of two elements: a connecting (inner) element 126 and a detachable (outer) element 128. The connecting element 126 generally locates against to be retained at the building components 102*a*, 102*b*, whilst the detachable element 128 defines a removable external corner of the connector 104.

The connecting element 126 comprises two sidewalls 130, 132 that are perpendicular to one another so as to form the connecting element 126 as a generally L-shaped profile. The L-shaped profile corresponds to an internal corner that is defined by the proximate ends 114, 116 of the two perpendicular building formwork components 102*a*, 102*b*. That is, the two sidewalls 130, 132 of the connecting element 126 locate against (and partially cap) the ends 114, 116 of the building formwork components 102*a*, 102*b* respectively.

Although not shown in the figures, the sidewalls 130, 132 can each comprise apertures that align with apertures 112 that are formed in the webs 108 of the building formwork components 102*a*, 102*b*. These apertures allow e.g. reinforcement bars, cabling, plumbing, etc. to pass into (or to be passed from) the connector 104 from/into the building formwork components 102*a*, 102*b*. They also allow cementitious material to flow between the cavities 110 of the building formwork components and a connector cavity 144 that is defined between the connecting element 126 and detachable element 128 of the connector 104.

Whilst the connecting element 126 is depicted in FIG. 1 as having two sidewalls 130, 132 that are integrally formed to define the generally L-shaped profile, as set forth hereafter, the sidewalls 130, 132 can be separately manufactured and separately mounted to their respective building formwork components 102*a*, 102*b*.

A first 130 of the two sidewalls of the connecting element 126 comprises a generally planar surface with an engagement portion in the form of hook- or L-shaped flange 122 that projects in the direction of the first building formwork component 102*a*. Flange 122 hooks around the first building formwork component 102*a* so as to engage with a corresponding groove 118 of the first building formwork component 102*a*.

The first sidewall 130 also comprises a U-shaped flange 136 extending therefrom. Flange 136 projects from an opposing surface (i.e. the surface facing away from the first building formwork component 102*a* at an opposite side to the flange 122 and at a distal end of sidewall 130 (i.e. distal from its intersection with the second sidewall 132). The U-shaped flange 136 engages with and retains the detachable element 128 of the connector 104 (which will be described in more detail below).

A second 132 of the two sidewalls of the connecting element 126 comprises a generally planar surface with two engagement portions (i.e. a second set of engagement portions) in the form of hook- or L-shaped flanges 124 that project in the direction of the second building formwork component 102*b*. One of the engagement portions 124 is disposed at an end of the second sidewall 132 that is proximate its intersection with the first sidewall 130. The other engagement portion 124 is disposed at an opposite (distal) end of the second sidewall 132. The engagement portions 124 of the second sidewall 132 engage with corresponding flanges 120 of the second building formwork component 102*b*.

The second sidewall 132 also comprises a further flange 138 disposed on the opposing surface (i.e. the surface facing away from the second building formwork component 102*b*) at the distal end of the second sidewall 132. This flange 138 is U-shaped and engages the detachable element 128 of the connector 104 (which will be described in more detail below).

Together, the U-shaped flange 138 of the second sidewall 132 and the U-shaped flange 136 of the first sidewall 130, retain the detachable element 128 at a corner of the first 102*a* and second 102*b* of the building formwork components.

When retained in this way, the connector 104 is in a closed configuration so as to define a cavity 144 that is in fluid connection/communication with the cavities 110 of the building formwork components 102*a*, 102*b* (i.e. such that cementitious material can flow between the connector 104 and the building formwork components 102*a*, 102*b*, and such that the resultant cured cementitious material is contiguous in the connector 104 and components 102*a*, 102*b*).

The detachable element 128 can also be detached from the connecting element 126, such as by sliding the detachable element 128 relative to the connecting element 126 (alternatively, this detachment/attachment may be by way of a snap-fit). This opens the cavity 134 of the connector 104 and allows access by a user to the cavity 134. Such access can be desirable as it can allow an operator to inspect and/or maintain various internal features of the building formwork system 100 prior to cementitious material being supplied to (and filling) the cavities 110, 144 of the building formwork components 102*a*, 102*b* and the connector 104.

One such internal feature of the system that can require inspection and/or maintenance is reinforcement elements, in the form of reinforcement bars 140. The bars 140 are arranged to extend through the apertures 112 in the building formwork components 102*a*, 102*b*.

In the illustrated embodiment, the reinforcement bars 140 are generally U-shaped. In this regard, the 'legs' of the 'U' of the reinforcement bars 140 extend into the building formwork components 102*a*, 102*b* (through the apertures 112), while the central (U-) portions of the reinforcement bars 140 locate within the cavity 144 of the connector 104. Hence, detachment of the detachable element 128 can allow an operator to inspect the portions of the reinforcement bars 140 that are located within the cavity 144, prior to filling the cavity 144 with a cementitious material.

Another benefit of the detachable element 128 is that it facilitates construction of the system 100. In practice, a wall is generally built outwardly from the corner. First, the corner (i.e. the connector 104) is installed. Then, the building formwork components 102*a*, 102*b* are connected to the connector. These components 102*a*, 102*b*, 104 are then braced for extra support while further building formwork components are connected (i.e. to form respective walls).

Once the walls are formed, reinforcement bars 140 are positioned in the cavities 110, 144, through the apertures 112. Where these reinforcement bars 140 meet (i.e. in the corner cavity 144) it can be desirable for them to overlap so as to define a vertically extending passage (i.e. between the curved central portions of the reinforcement bars 140) through the corner cavity 144. A vertical reinforcement bar (not shown) can also be arranged and received in this vertical passage.

Removal (i.e. by detaching) of the detachable element 128 makes it easier to install the horizontal reinforcement bars 140, because they can be pushed into the apertures 112 from the open corner cavity 144. It also makes it easier for an operator to ensure that the reinforcement bars 140 overlap appropriately to define the vertical passage.

Figure 1A:
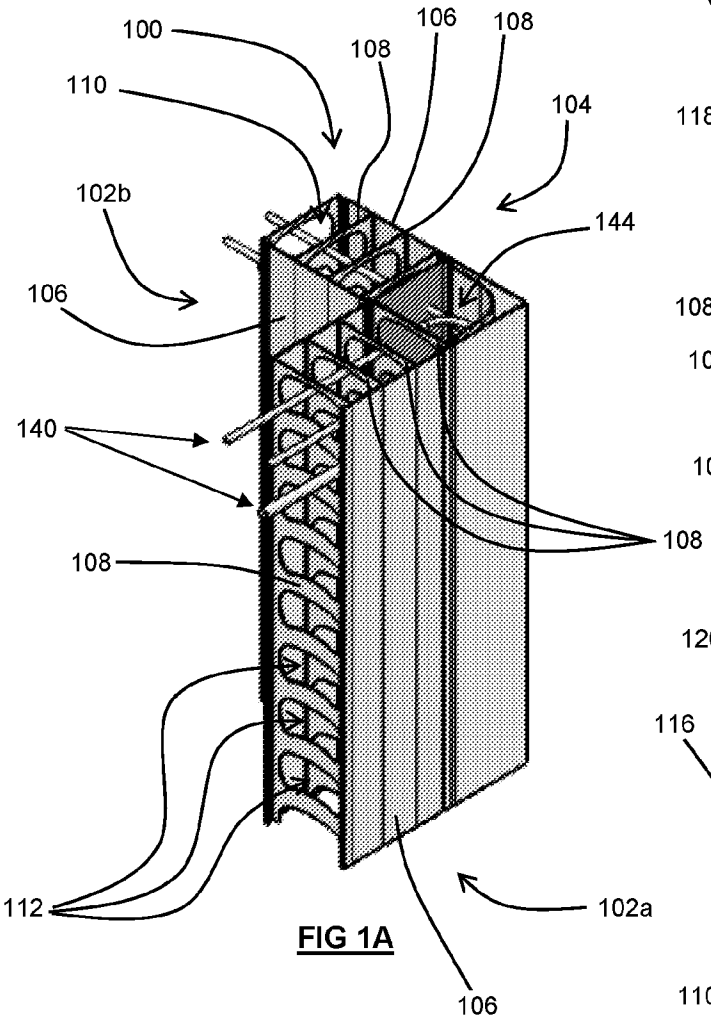
Figure 1D:
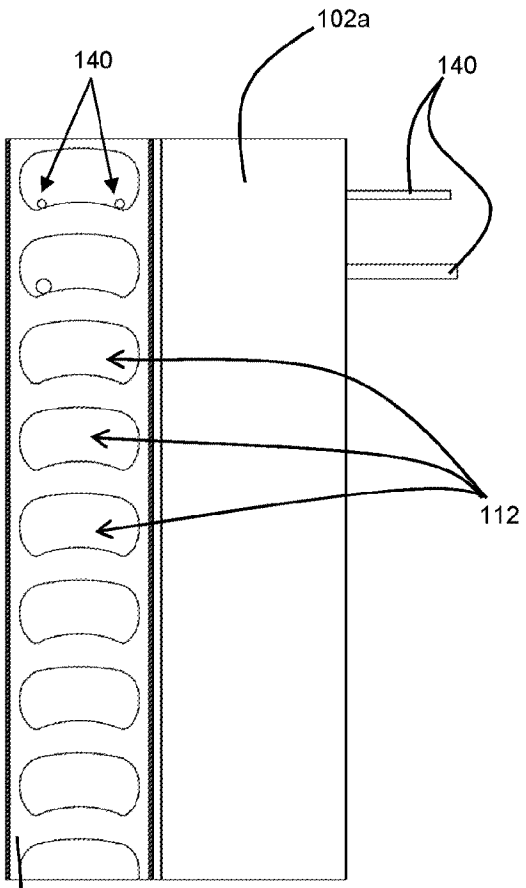
Figure 1C:
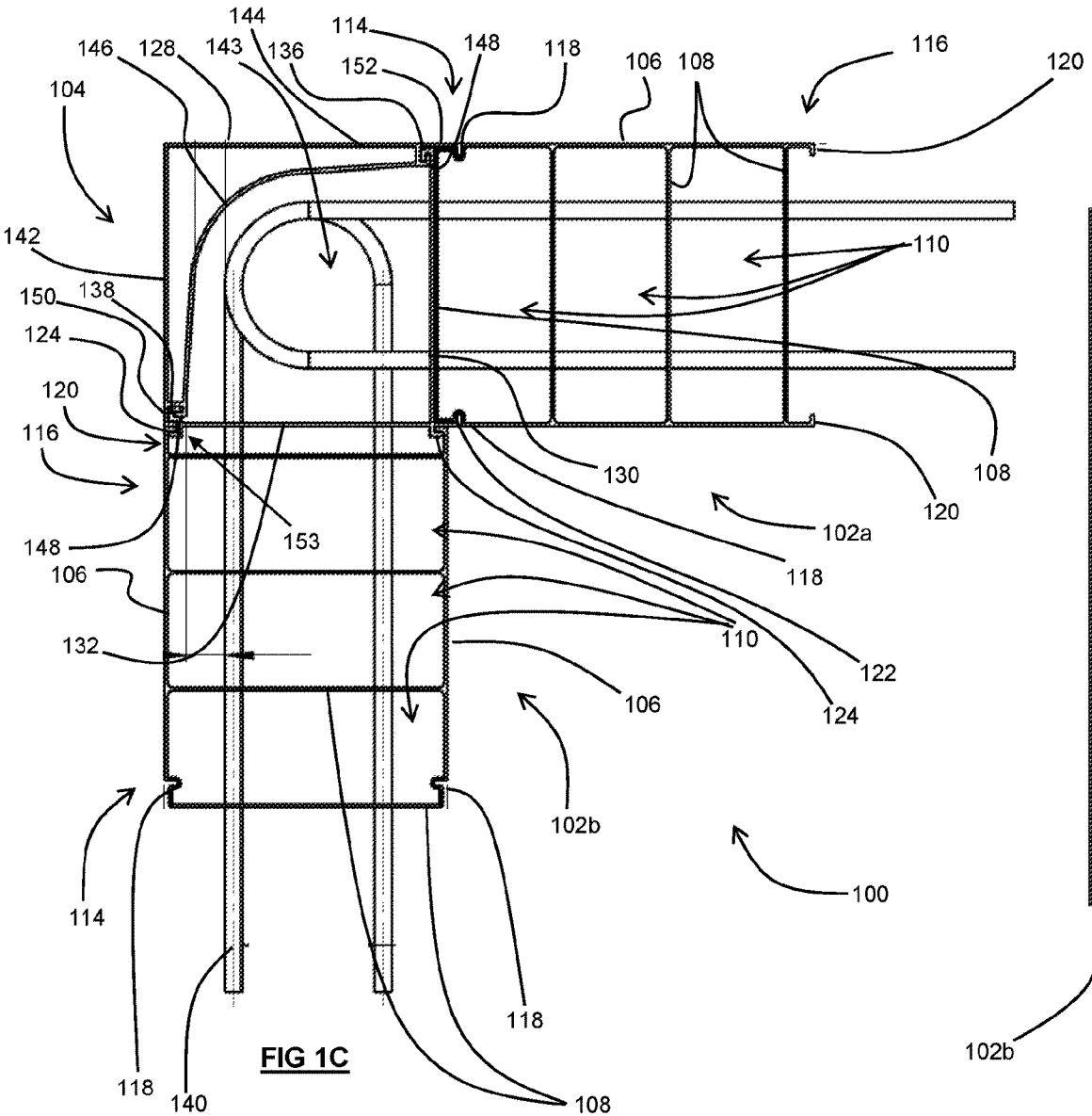
Figure 2B:
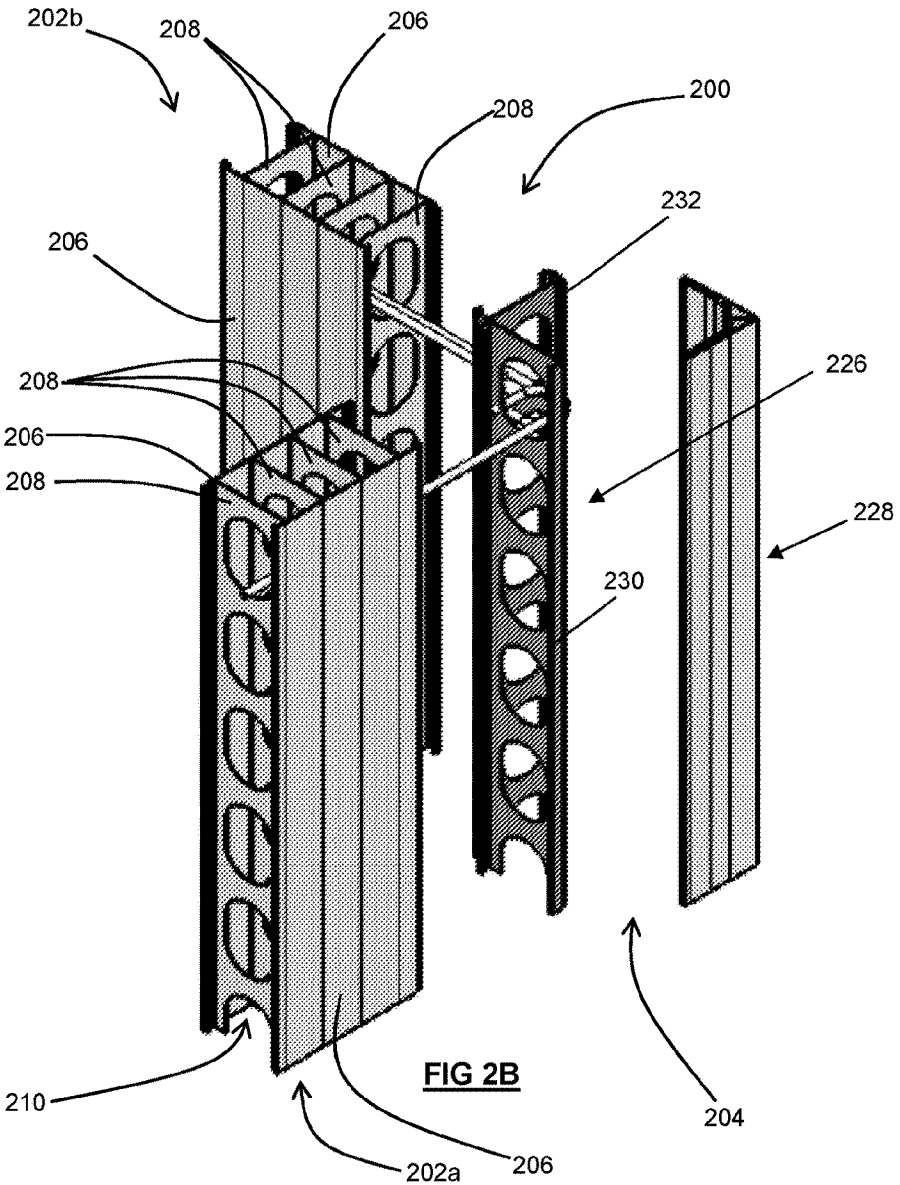
FIGS. 2A, 2B, 2C and 2D are respective perspective, exploded perspective, top and partial front views of a second embodiment of a formwork system.
Figure 2A:
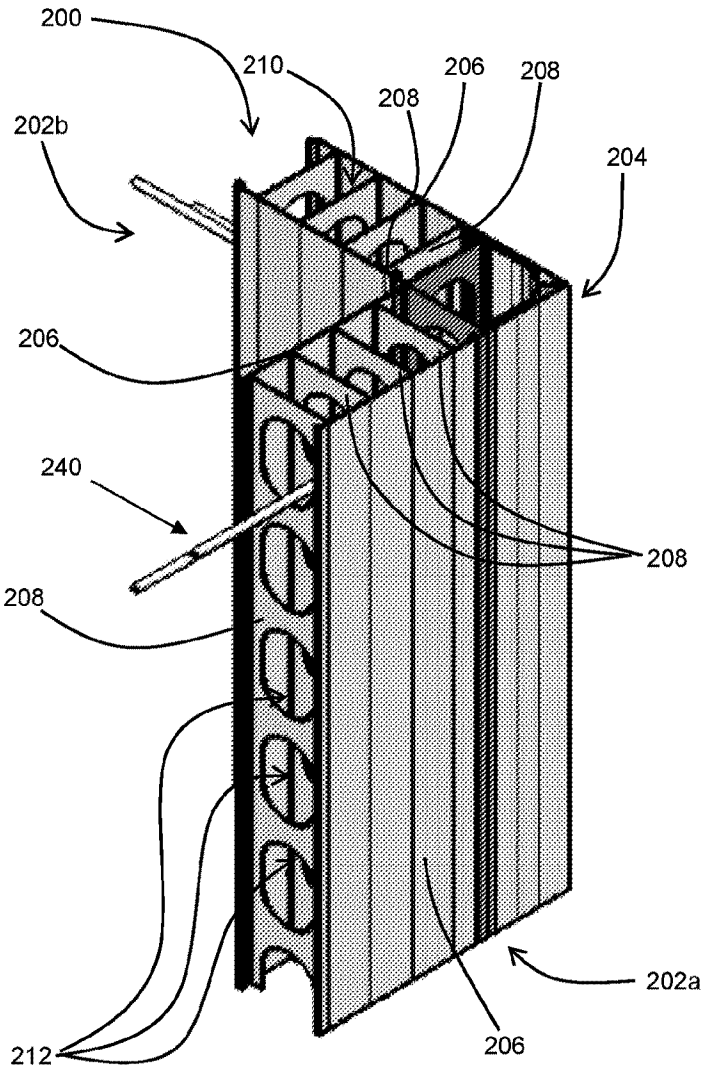
Figure 2D:
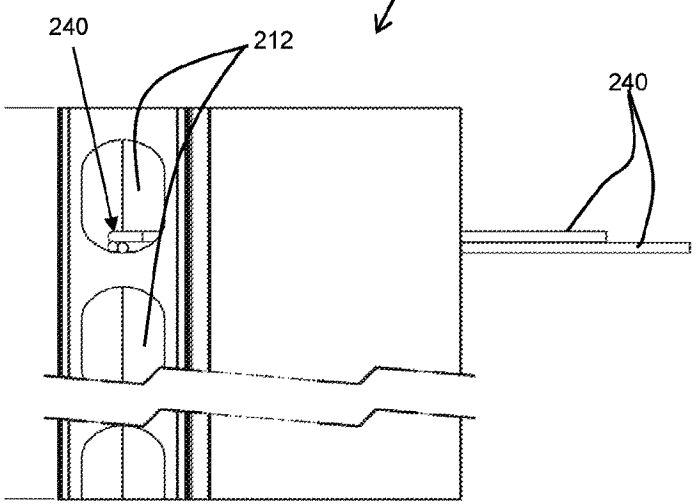
Figure 2C:
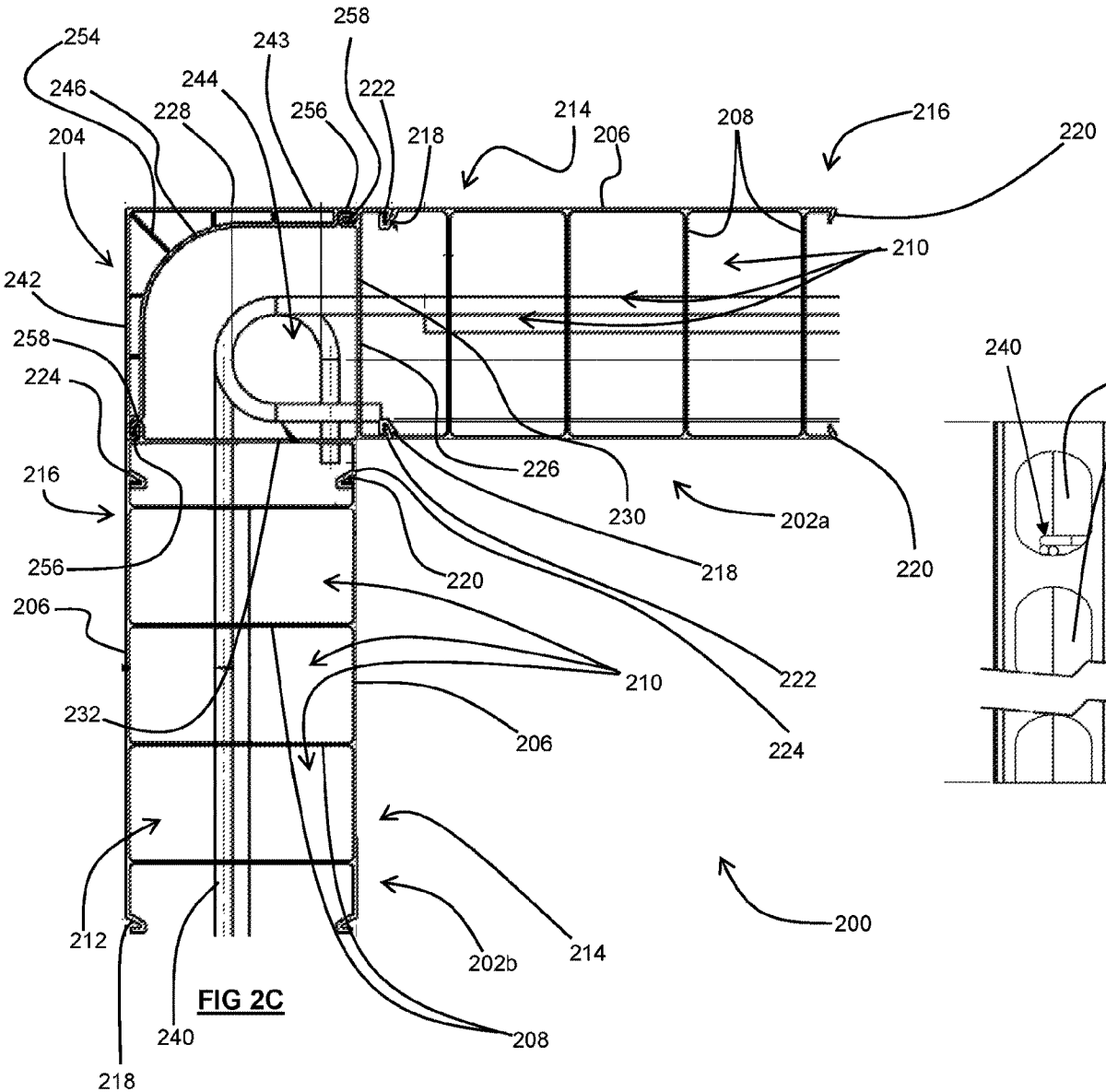

As best illustrated in FIGS. 1A & 1C, the detachable element 128 is shaped so as to accommodate the U-shaped ends of the reinforcement bars 140. In this regard, the detachable element 128, like the connecting element 126, has a generally L-shaped profile. This profile is formed from three sidewalls 142, 143, 146 arranged in a generally triangular (or boomerang) configuration. This configuration acts as a hollow section or hollow beam so as to resist torsional loads or shear loading placed on the detachable element 128. In other words, the configuration of the sidewalls can also provide strength and rigidity to the detachable element 128. First 142 and second 143 sidewalls of the detachable element 128 are perpendicular to one another and define the external corner surface of the connector 104. The third wall 146 extends in a curved manner between the first 142 and second 143 sidewalls.

In the closed configuration, and when the connector 104 is engaged with the building formwork components 102*a*, 102*b*, the outer surfaces of the first 142 and second 143 sidewalls of the detachable element 128 are generally flush with the corresponding outer surfaces of the building components 102*a*, 102*b*. In this way, the outer surfaces of the formwork components 102*a*, 102*b* and connecter 104 form generally continuous planar surfaces. Hence, in some circumstances further finishing of the surfaces may not be required, or the surfaces may only require minimal finishing.

It will also be seen in FIG. 1C that one end edge of the detachable element 128 detachably engages (or attaches to) both the sidewall 130 and the first building formwork component 102*a*, and detachably engages (or attaches to) both the sidewall 132 and the second building formwork component 102*b*.

In this regard, engagement of the detachable element 128 with the first building formwork component 102*a* is by way of a formwork-engaging flange 152 that extends inwardly from the second sidewall 143 of the detachable element 128. This flange 152 is formed such that it engages one of the outer grooves 118 of the first building formwork component 102*a*.

Further in this regard, engagement of the detachable element 128 with the sidewall 130 is via an outwardly projecting hook- or L-shaped flange 148 located at an end of the third sidewall 146 of the detachable element 128. This hook-flange 148 engages with (i.e. hooks around) the corresponding flange 136 (previously described) of the sidewall 130.

In a somewhat similar manner, engagement of the detachable element 128 with the second building formwork component 102*b* is by way of an outer flange 150 that extends inwardly from the first sidewall 142 of the detachable element 128. However, outer flange 150 is formed such that it engages into an outwardly facing groove 153 that is defined between the L-shaped engagement portion 124 and the U-shaped flange 138 at the distal end of the sidewall 132.

The outer flange 150 also abuts a corresponding flange 120 of the second building formwork component 102*b* (i.e. they are both received in the groove 153 defined between the U-shaped flange 138 and the L-shaped engagement portion 124 of the sidewall 132. The insertion of outer flange 150 into the groove 153 thus locks the flange 120 of the first building formwork component 102*a* against the L-shaped engagement portion 124 of the sidewall 132.

Again, in a somewhat similar manner, further engagement with the connecting element 132 is provided by an opposite end of the third sidewall 146 of the detachable element 128 being provided with an outwardly projecting hook- or L-shaped flange 148. This hook-flange 148 engages with (i.e. hooks around) the corresponding flange 138 (previously described) of the sidewall 132.

Referring now to FIGS. 2A, 2B, 2C and 2D, a further embodiment of the formwork system is illustrated. This formwork system 200 is similar to that described above in that it comprises a connector 204 and first 202*a* and second 202*b* building formwork components that (once filled with cementitious material) form a corner section of a wall. However, the building formwork components 202*a*, 202*b* of this embodiment differ in the way they engage with one another (and in the way they engage with the connector 204).

Another difference is that webs 254 are formed between the first 242 and second 243 (external) walls of the detachable element 228 and the third curved wall 246. These webs 254 provide rigidity and strength to the detachable element 228 (i.e. in addition to the strength provided by the hollow shape defined by the sidewalls of the detachable element 228).

The flanges 220 of the building formwork components 202*a*, 202*b* (at their respective second ends 216) extend inwardly from the sidewalls 206 and at an angle such that an outer surface of each flange 220 generally defines a ramp surface. The grooves 218 of the building formwork components 202*a*, 202*b* (at their first ends 214) have a generally V-shaped profile that correspond to the flanges 220. To connect two building formwork components 202, they are moved laterally towards one another such that the ramp surfaces of the flanges 220 contact the ends of the sidewalls adjacent the grooves 218. Further movement causes the flanges 220 and/or sidewalls 206 to flex until the flanges 220 snap into the grooves 218. In other words, the building formwork components 202*a*, 202*b* are configured to snap-engage with one another.

This difference in configuration somewhat necessitates an alternative connector 204 (i.e. to that described above and illustrated in FIGS. 1A, 1B, 1C and 1D).

The connector 204 again comprises an (inner) connecting element 226 and an (outer) detachable element 228. Unlike the previously described embodiment, these elements 226, 228 are generally symmetrical about a diagonal line of symmetry. As a result, the detachable component 228 is engaged solely with the connecting element 226, and not with either of the building formwork components 202*a*, 202*b*. This engagement is by way of hook-shaped flanges 256 extending from respective distal ends of first 242 and second 243 sidewalls of the detachable component 228, and corresponding hook-shaped flanges 258 extending from distal ends of first 230 and second 232 sidewalls of the connecting element 226. The nature (shape) of the hook-shaped flanges 256, 258 is such that the engagement between the detachable 228 and connecting 226 elements is a sliding engagement.

The engagement of the connection element 226 with the building formwork components 202*a*, 202*b* also differs. Each sidewall 230, 232 of the connecting element 226 comprises two engagement portions 222, 224, in the form of flanges extending therefrom, for engagement with a respective building formwork component 202*a*, 202*b*. First engagement portions 222, in the form of a first pair of flanges, extends from the first sidewall 230 of the connecting element 226. Each of this first pair of engagement portions 222 comprises a secondary flange that extends inwardly in an angled manner (i.e. similar to flanges 220) so as to snap engage a corresponding groove 218 of the first formwork component 202*a*.

Second engagement portions 224, in the form of a second pair of flanges, extend from the second sidewall 232 of the connecting element 226 (in the direction of the second building formwork component 202*b*). Each of this second pair of engagement portions 224 comprises a V-shaped groove that is similar (or identical) to those formed at the first end 214 of each building formwork component 202*a*, 202*b*. In this way, the flanges 220 of the second building formwork component 202*b* can engage with the engagement portions (i.e. grooves) 224 of the connecting element 226 in the same way that they engage with another like-building formwork component. That is, the flanges 220 of the second building component 202*b* snap-engage with the grooves 224 of the connecting element 226.

A further difference between the present embodiment and that described above derives from the differently shaped apertures 212. In this regard, the obround shape of apertures 212 requires that just the end of the illustrated reinforcement members 240 be hook-shaped (U-shaped). That is, one leg is longer than the other, with the short leg having a length such that it just extends back through e.g. a discrete aperture provided in the sidewall 230 (see FIG. 2B).

Figures 3A, 3B, 3C:
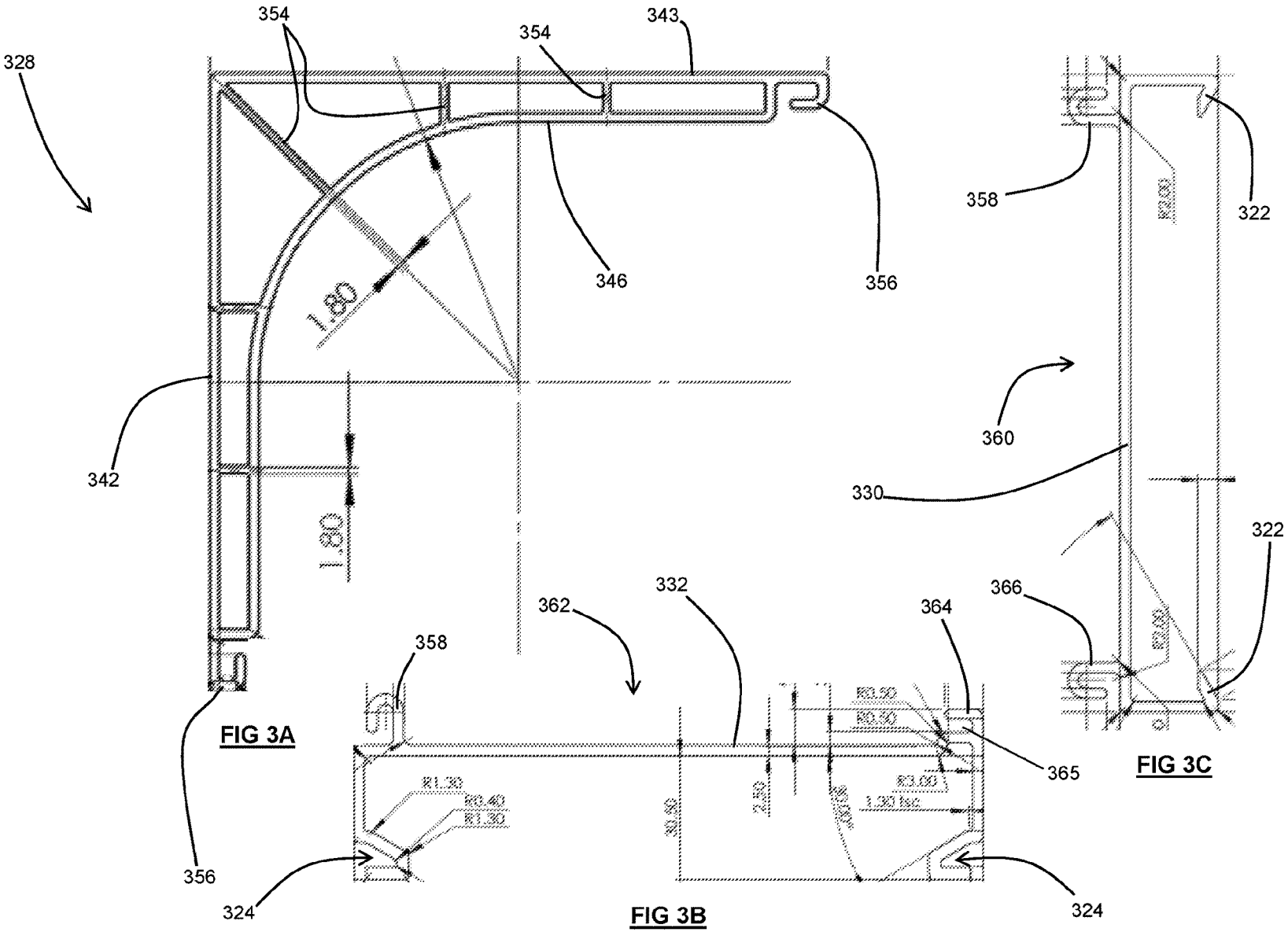
FIGS. 3A, 3B and 3C are top views of elements of the connector of a third embodiment.

FIGS. 3A, 3B and 3C illustrate a similar system 300 to that shown in FIGS. 2A, 2B, 2C, 2D. In particular, the engagement of the connecting element 326 with the detachable element 328 and the building formwork components 302*a*, 302*b* is generally the same as those described above.

Figure 3E:
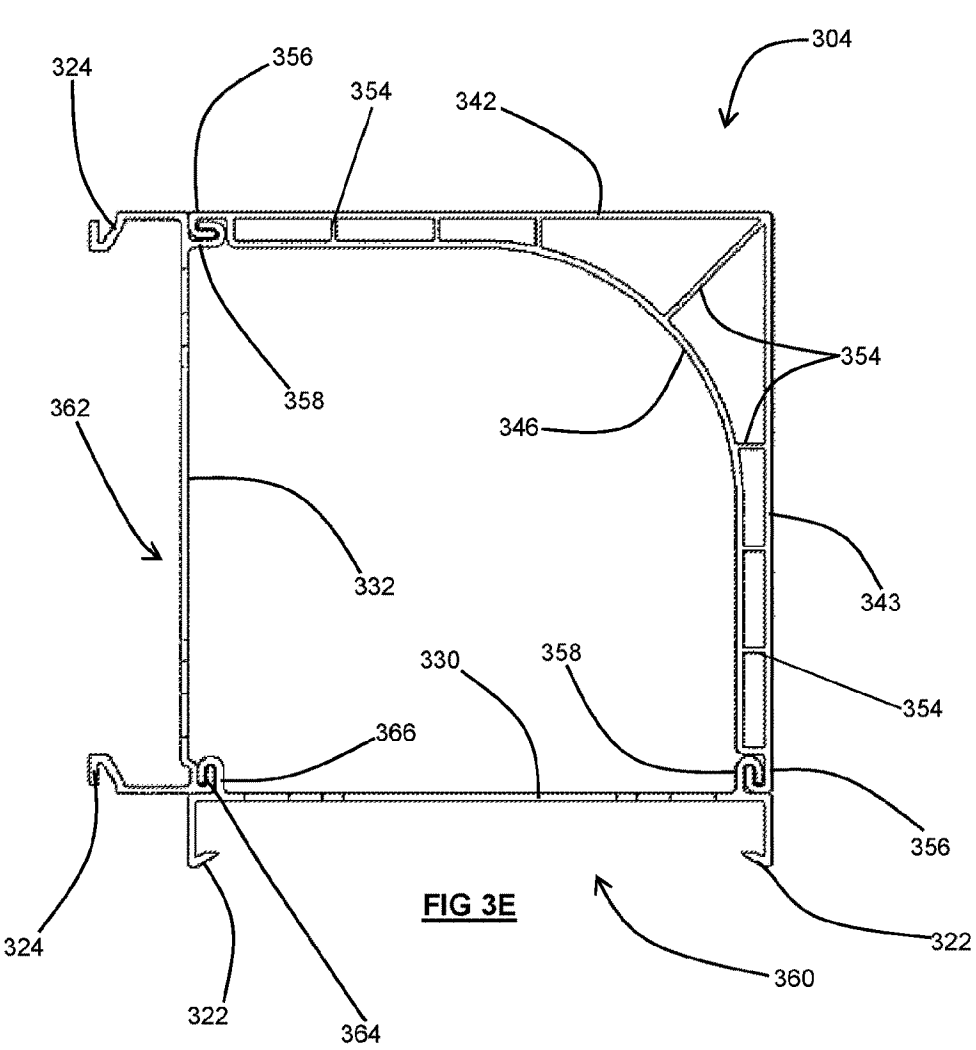
FIGS. 3E and 3D are perspective (exploded) and top (assembled) view of the connector of the third embodiment.
Figure 3D:
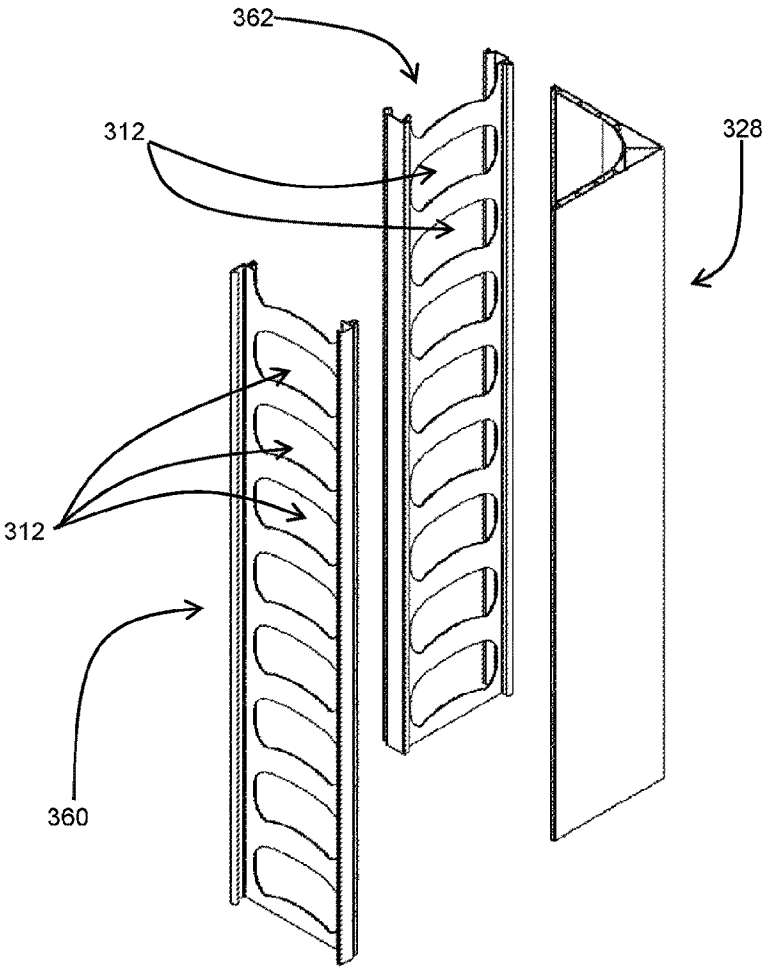

The only significant difference in the embodiment of FIG. 3 is that the connecting element 326 is formed of first 360 and second 362 separable parts (i.e. whereas in the previously described embodiments it was depicted as being formed of a single, integral component). Each of these parts 360, 362 generally forms a respective sidewall 330, 332 of the connecting element 326. In this respect, the connector 304 may be considered a three-piece connector, as opposed to a two-piece connector (which may be used to describe the above described embodiments).

To facilitate connection of the first part 360 (comprising the first sidewall 330) to the second part 362 (comprising the second sidewall 332), the first part 360 comprises a hook-shaped flange 366 and the second part comprises a corresponding L-shaped flange 364 that defines a groove 365. The hooked flange 366 located in the groove 365.

In practice, the hook-shaped flange 366 of the first part 360 is hooked into (or interlocks with) the groove 365 formed by the L-shaped flange 364 of the second part 362 so as to interlock the first 360 and second 362 parts together to form the connecting element 326. The flanges 322 of the first part 360 are connected to the grooves 218 at the first end 214 of the first building formwork component 202*a* (i.e. by way of snap-engagement). Likewise, the grooves 324 of the second part 362 are connected to the flanges 220 at the second end 216 of the second building formwork component 302*b*.

The use of three pieces, instead of two, may allow the connector 304 to be transported as a smaller (e.g. flat) package. It may also facilitate interchanging of the parts of the connecting element where two building components of a different type (e.g. one engageable by way of snap engagement, and another by way of sliding) are to be connected to one another.

Figure 4B:
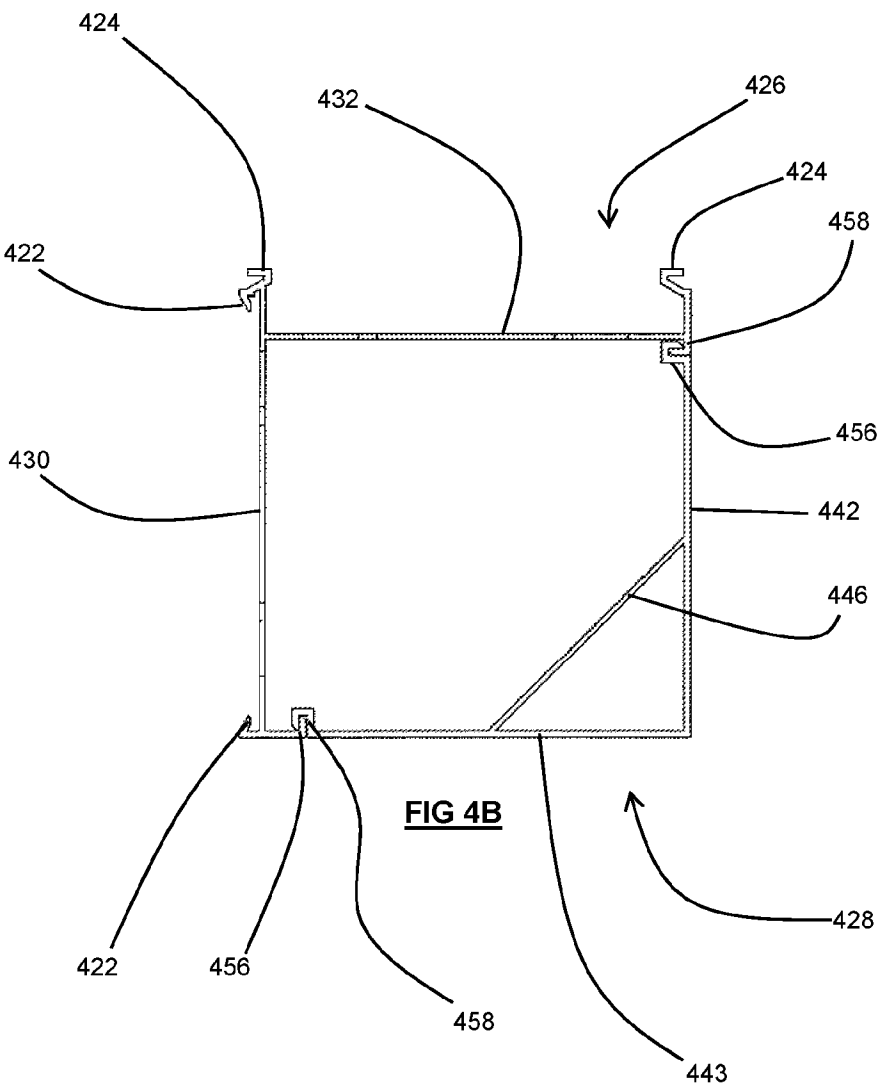
FIGS. 4A and 4B are perspective (exploded) and top (assembled) views of a connector of a fourth embodiment.
Figure 4A:
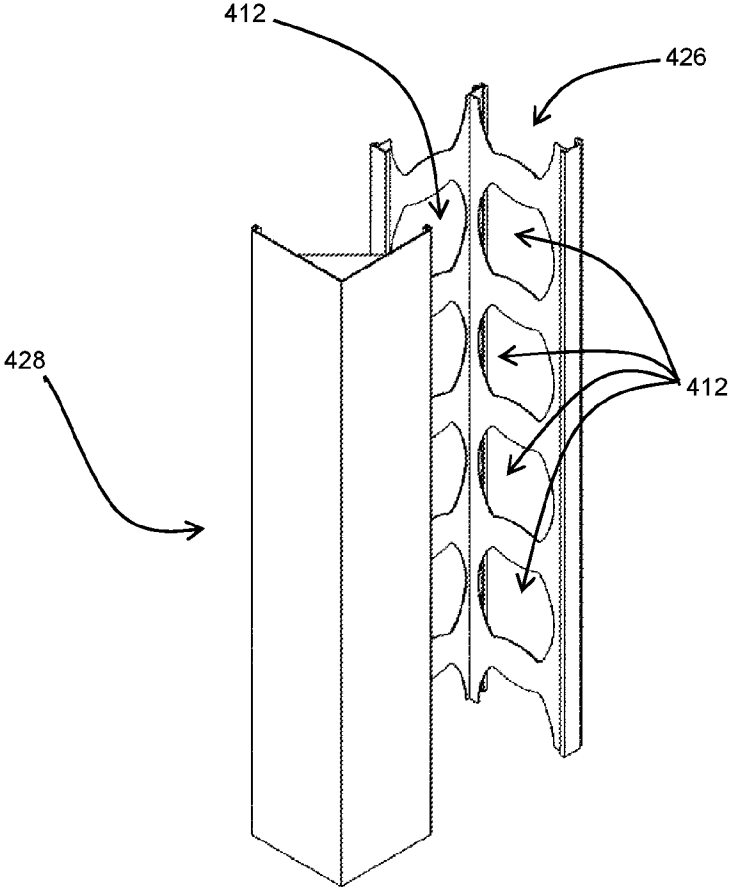

A further embodiment of the system is illustrated in FIGS. 4A and 4B. This system 400 is a two-piece connector, like those described above and shown in FIGS. 1A-1D and 2A-2D. In particular, this system 400 is most similar to that shown in FIGS. 2A-2D, in that the connector 404 includes engagement portions 422, 424 that snap-engage with corresponding grooves 418 and flanges 420 of corresponding formwork components (not shown). Further, the connecting 426 and detachable 428 elements of the connector 404 are slideably engageable by way of hook-shaped flanges 456, 458.

The system 400 of FIG. 4 differs from the previously described embodiments, in that the third sidewall 446 of the detachable element 428 joins the first 442 and second 443 sidewalls partway therealong so as to form a brace-like structure. In this way, the sidewalls 442, 443, 446 define a triangular cavity.

The system 400 of FIG. 4 also differs slightly in that it the inner-most (to the internal corner) of the first 422 and second 444 engagement portions are integrally formed to be adjacent to one another. In this way, the formwork components define the internal corner of the system 400 (i.e. as opposed to the connector 404 forming the internal corner).

Figure 5B:
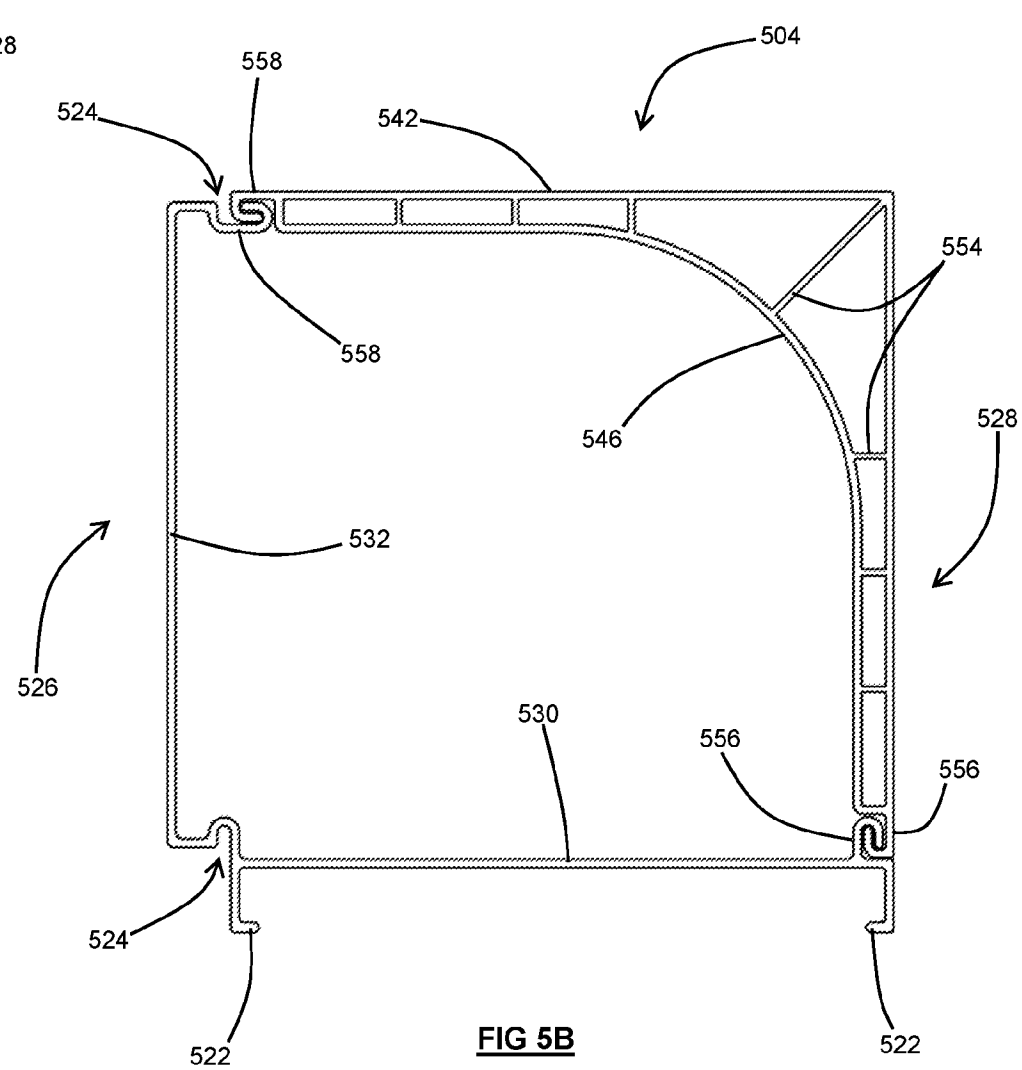
FIGS. 5A and 5B are perspective (exploded) and top (assembled) views of a connector of a fifth embodiment.
Figure 5A:
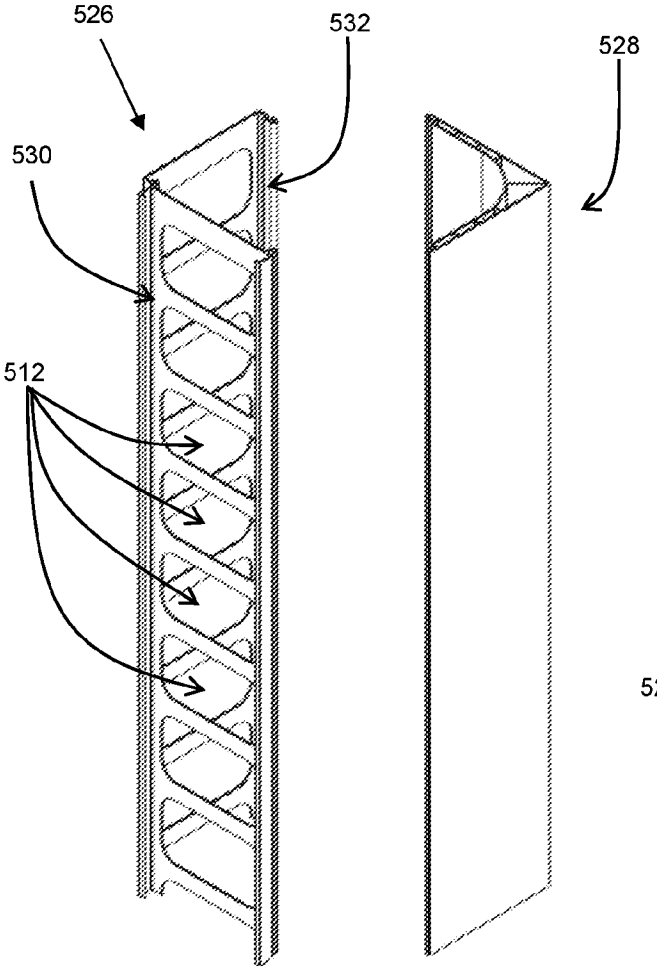

Another two-piece connector 504 is illustrated in FIGS. 5A and 5B. Like the embodiment illustrated in FIGS. 3A to 3E, the engagement between the detachable 528 and connecting 526 elements in this embodiment is in the form of a slideable engagement between hooked-shaped flanges 556, 558. However, unlike the connector 304 of FIGS. 3A to 3E, the connector 504 is generally not configured for snap-engagement with respective building components. Rather, the engagement portions 522, 524 of the connector 504 are in the form of flanges 522 and grooves 524 for slideable engagement with corresponding grooves and flanges of the respective building components.

Figure 6:
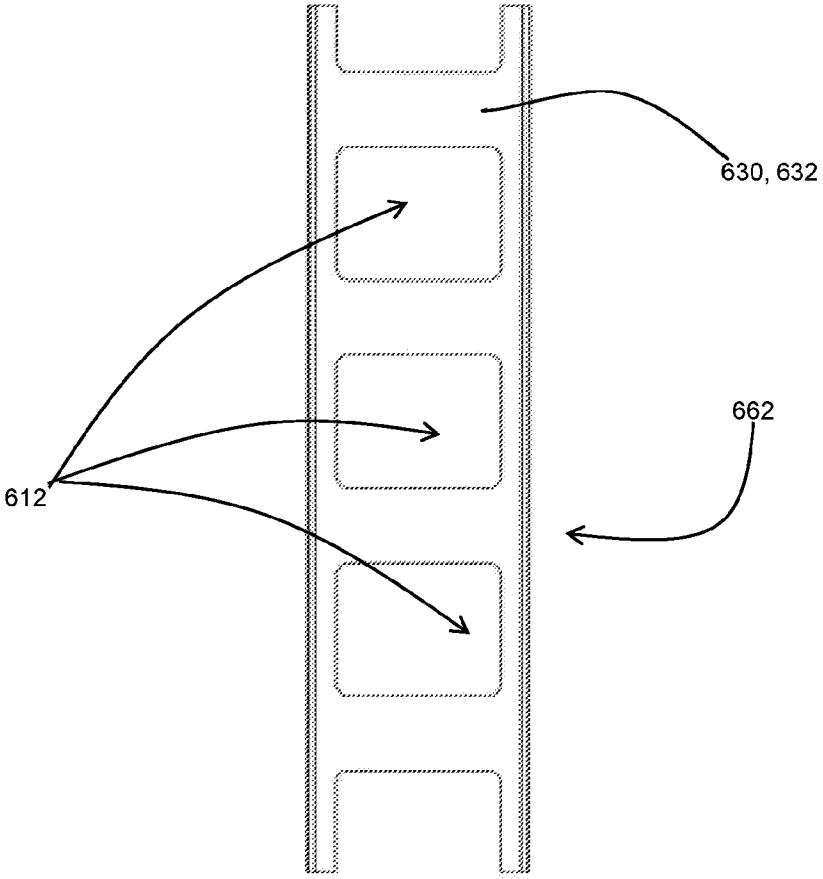
FIG. 6 is a front view of a separable part of a sixth embodiment.

A further embodiment is illustrated in FIG. 6. Only a separable part 662 of the connector is shown for the purposes of illustrating the possibility of varying the shape of the apertures 612 in the sidewall 630 and/or 632 of the connector. In the previously illustrated embodiments, the apertures are generally arcuate or bean shaped. In this embodiment, the apertures 612 are rectangular. Because the apertures 612 are symmetrical about a transverse axis, it does not matter which way (e.g. right way up or upside down) the part 662 is connected to a building formwork component. Although these apertures are shown on an embodiment which includes a separable part 662, it should be apparent that such an aperture shape may be used in any of the embodiments described above.

Variations and modifications may be made to the parts previously described without departing from the spirit or ambit of the disclosure.

One such variation or modification may be that the connector only connects to the outermost flanges or grooves of the formwork component and the entire connector is detachable from the formwork components to allow access to the cavity. In such case, it may be that the formwork components are configured such that they connect to one another at their innermost flanges/grooves (i.e. adjacent one another at the interior corner). Such connection of formwork components at their innermost flanges/grooves located at the interior corner may, for example, be facilitated e.g. by an elongate connection strip.

Further, the manner of engagement between the connector and the formwork components may differ from that described above. Other than being a slideable or snap-fit engagement, the connection may be by way of fasteners or even adhesive.

The form of the connector may be modified so as to be suitable for various connection shapes (e.g. various corner angles). In this respect, the connector may be capable of connection to more than two building formwork components. For example, the connector may connect three or four building components.

The detachable element may also differ from that described above. For example, the detachable element may be in the form of a hinged door or hatch located in or forming a sidewall of the connector. In this case the element can be moveable rather than being detachable. Alternatively, the detachable element may be a removable piece in a sidewall of the connector so as to form a window in the sidewall when removed or detached therefrom.

In the claims which follow and in the preceding description of the building formwork connector and associated system and methodology, except where the context requires otherwise due to express language or necessary implication, the word "comprise" or variations such as "comprises" or "comprising" is used in an inclusive sense, i.e. to specify the presence of the stated features but not to preclude the presence or addition of further features in various embodiments of the connector, system and methodology.

The invention claimed is:

1. A building formwork system comprising:

first and second building formwork components, each comprising spaced sidewalls having spaced webs extending therebetween so as to define cavities within the first and second formwork components, the cavities being configured for receipt of a cementitious material, one of the spaced webs being located at a respective end of each of the first and second building formwork components;

a connector connecting the first and second formwork components at the respective ends, the connector comprising one or more sidewalls having a detachable portion that is movable from a closed position to an open position;

wherein:

in the closed position, the one or more sidewalls define a cavity in the connector configured for receipt of the cementitious material, the cavity defined by the connector located at the respective ends of the first and second formwork components, with one of the one or more sidewalls being located to extend across a respective end proximate to a respective said one of the spaced webs; and in the open position, access is provided to the cavity defined by the connector;

wherein said detachable portion includes a detachable element configured to provide said access to the cavity defined by the connector in the open position, the detachable element comprising two external sidewalls defining an external corner of the connector, and one or more internal sidewalls that extend therebetween, the internal sidewalls partially defining the cavity defined by the connector.

2. The building formwork system according to claim 1 wherein the first and second building formwork components and the connector together form a corner of a wall structure.

3. The building formwork system according to claim 1 wherein the cavity defined by the connector is defined between the detachable element and the one or more sidewalls extending across the respective ends of the formwork.

4. The building formwork system according to claim 1 wherein the detachable element is detachably connectable to at least one of the first and second formwork components.

5. The building formwork system according to claim 1 wherein an outer surface of the connector is configured to be flush with corresponding outer surfaces of the first and second formwork components when engaged thereto.

6. The building formwork system according to claim 1 wherein one or more of the sidewalls of the connector comprises at least one aperture for receipt of a reinforcement member therethrough, the reinforcement member able to extend from the cavity defined by the sidewalls and into a cavity of an engaged one of the first and second formwork components.

7. The building formwork system according to claim 1 wherein the cavity defined by the one or more sidewalls of the connector is in fluid communication with a cavity of at least one of the first or second building formwork components.

8. The building formwork system according to claim 1, wherein one or both of the internal sidewalls comprises at least one aperture for receipt of a reinforcement member therethrough, with the system further comprising at least one said reinforcement member, the at least one reinforcement member extending through the at least one aperture and into the cavity of a respective one of the first and second formwork components, an end of the reinforcement member disposed in the connector cavity.

9. The building formwork system according to claim 8 wherein the reinforcement member is U-shaped, legs of the reinforcement member extending through apertures in the internal sidewalls and into the cavities of the first and second building formwork components, a central portion of the reinforcement member, connecting the legs, being disposed in the connector cavity.

10. The building formwork system according to claim 1 wherein the external sidewalls and internal sidewall configure the detachable element as a hollow section.

11. The building formwork system according to claim 10 wherein support webs extend within the hollow section, between the internal sidewall and external sidewalls.

12. The building formwork system according to claim 1 wherein the connector further comprises a connecting element, the connecting element comprising engagement portions for engaging each of the first and second formwork components at the respective ends thereof.

13. The building formwork system according to claim 12 wherein the detachable element is at least one of (i) detachably connectable to the connecting element by way of a snap-fit arrangement or (ii) is connectable to the connecting element by way of a sliding arrangement.

14. The building formwork system according to claim 12 wherein the connecting element comprises respective sidewalls of the one or more sidewalls, the respective sidewalls of the connecting element being engageable with the respective ends of the first and second formwork components by way of one or more of: a sliding arrangement or a snap-fit arrangement.

15. The building formwork system according to claim 14 wherein a first of the respective sidewalls of the connecting element extends across the respective end proximate to the respective said one of the spaced webs of the first formwork component when engaged thereto; and wherein a second of the respective sidewalls of the connecting element extends across the respective end proximate to the respective said one of the spaced webs of the second formwork component when engaged thereto.

16. The building formwork system according to claim 15 wherein the first respective sidewall comprises at least one engaging flange extending therefrom to engage corresponding flanges of the first formwork component, and wherein the second respective sidewall comprises at least one engaging flange to engage a corresponding groove of the second formwork component.

* * * * *